US010767816B1

(12) United States Patent
Wu et al.

(10) Patent No.: US 10,767,816 B1
(45) Date of Patent: Sep. 8, 2020

(54) LIGHT BULB APPARATUS

(71) Applicant: XIAMEN ECO LIGHTING CO. LTD., Xiamen (CN)

(72) Inventors: Chenjun Wu, Xiamen (CN); Chengzong Wu, Xiamen (CN); Hongkui Jiang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/439,705

(22) Filed: Jun. 13, 2019

Related U.S. Application Data

(60) Provisional application No. 62/838,274, filed on Apr. 24, 2019.

(51) Int. Cl.

| | |
|---|---|
| ***F21K 9/232*** | (2016.01) |
| ***F21V 29/507*** | (2015.01) |
| ***F21V 23/00*** | (2015.01) |
| ***F21V 29/85*** | (2015.01) |
| ***F21V 29/70*** | (2015.01) |

(52) U.S. Cl.
CPC ..... *F21K 9/232* (2016.08); *F21V 23/009* (2013.01); *F21V 29/507* (2015.01); *F21V 29/70* (2015.01); *F21V 29/86* (2015.01)

(58) Field of Classification Search
CPC ..... F21K 9/232; F21V 29/86; F21V 29/507; F21V 29/70; F21V 23/009
See application file for complete search history.

(56) References Cited

U.S. PATENT DOCUMENTS

| | | | | |
|---|---|---|---|---|
| 2,688,711 A * | 9/1954 | Camillerapp | H01K 1/18 | 313/276 |
| 4,144,473 A * | 3/1979 | Almer | H01K 1/14 | 313/315 |
| 4,812,710 A * | 3/1989 | Klam | H01K 1/40 | 313/271 |
| 5,384,510 A * | 1/1995 | Arnold | H01K 1/18 | 313/272 |
| 6,523,978 B1 * | 2/2003 | Huang | F21V 3/00 | 313/500 |
| 6,580,228 B1 * | 6/2003 | Chen | F21K 9/90 | 315/185 R |
| 6,774,546 B2 * | 8/2004 | Gibboney, Jr. | H01K 1/14 | 313/271 |

(Continued)

*Primary Examiner* — Tsion Tumebo
(74) *Attorney, Agent, or Firm* — Chun-Ming Shih; Lanway IPR Services

(57) ABSTRACT

A light bulb apparatus includes a light bulb shell, a bulb head, and a heat sink cup. The heat sink cup has a first end connected to the light bulb shell, and a second end connected to the bulb head. The light bulb apparatus includes a flexible filament and a central support. The flexible filament has a first terminal and a second terminal, and the central support provides a first electrode electrically connected to the first terminal, and provides a second electrode for electrically connected to the second terminal. The light bulb apparatus includes an expanding structure and a driver module. The expanding structure is mechanically coupled to the central support, and includes a plurality of holding portions for holding the flexible filament. The driver module is electrically connected to the bulb head and the central support for providing electrical power to the flexible filament.

19 Claims, 9 Drawing Sheets

(56) References Cited

U.S. PATENT DOCUMENTS 8,641,237 B2 * 2/2014 Chuang ..... F21V 29/713 362/249.02
9,353,937 B2 * 5/2016 Hussell ..... F21V 29/004
9,562,677 B2 * 2/2017 Negley ..... F21K 9/23
D801,556 S * 10/2017 Yao ..... D26/2
10,066,791 B2 * 9/2018 Zhang ..... H01L 33/62
D829,940 S * 10/2018 Wang ..... D26/2
10,267,460 B2 * 4/2019 Wu ..... F21K 9/238
10,344,920 B2 * 7/2019 Cao ..... F21V 17/101
10,436,392 B2 * 10/2019 Cao ..... F21K 9/232
2004/0008525 A1 * 1/2004 Shibata ..... F21K 9/232 313/271
2006/0255738 A1 * 11/2006 Kwong ..... H01J 9/34 313/634
2011/0181164 A1 * 7/2011 Lin ..... F21V 29/74 313/46
2012/0032577 A1 * 2/2012 Huang ..... F21K 9/232 313/318.01
2012/0307502 A1 * 12/2012 Walton ..... H01K 1/325 362/296.05
2014/0022789 A1 * 1/2014 Lin ..... F21K 9/232 362/249.02
2014/0268739 A1 * 9/2014 Veres ..... F21K 9/90 362/235
2014/0268740 A1 * 9/2014 Veres ..... F21V 29/70 362/235
2015/0131284 A1 * 5/2015 Berends ..... F21K 9/232 362/249.06
2016/0363267 A1 * 12/2016 Jiang ..... F21K 9/232
2016/0377237 A1 * 12/2016 Zhang ..... H01L 33/62 362/311.02
2017/0038050 A1 * 2/2017 Rao ..... F21V 15/04
2017/0122499 A1 * 5/2017 Lin ..... F21V 23/003
2018/0045380 A1 * 2/2018 Li ..... F21K 9/235
2018/0080611 A1 * 3/2018 Haberkorn ..... F21K 9/238
2018/0080612 A1 * 3/2018 Haberkorn ..... F21V 29/65
2018/0119892 A1 * 5/2018 Jiang ..... F21K 9/232
2018/0172218 A1 * 6/2018 Feit ..... F21V 23/06
2019/0277487 A1 * 9/2019 Ren ..... F21K 9/232
2019/0368667 A1 * 12/2019 On ..... F21K 9/237

* cited by examiner

LIGHT BULB APPARATUS

FIELD

The present invention is related to a light bulb apparatus, and is more particularly related to a light bulb apparatus with a flexible filament.

BACKGROUND

Light emitting diode (LED) light bulbs have advantages over traditional lighting solutions such as incandescent and fluorescent lighting because they are more durable, use less energy, operate longer, and may be controlled to deliver light of various colors. Therefore LED light bulbs with flexible filaments are becoming more popular as replacements for older lighting systems.

A traditional way to produce the light bulb with a flexible filament is to provide a few fixation rings on a central support of the light bulb, manually bend the flexible filament to pass through each of the fixation rings, and then fix the flexible filament. Such design requires a lot of manual work, so the production efficiency is low and the workmanship quality cannot be assured.

SUMMARY OF INVENTION

One objective of the invention is to provide a light bulb apparatus with a flexible filament; the new design proposed by the present disclosure includes a novel expanding structure to help improve the production efficiency and quality, and also reduce the manufacturing cost of the light bulb apparatus.

To achieve such objective, according to some embodiments of the present disclosure, the light bulb apparatus includes a light bulb shell, a bulb head, and a heat sink cup. The heat sink cup has a first end and a second end. The first end of the heat sink cup is connected to the light bulb shell, and the second end of the heat sink cup is connected to the bulb head. The light bulb apparatus includes a flexible filament for emitting light, and a central support. The flexible filament has a first terminal and a second terminal. The central support provides a first electrode electrically connected to the first terminal of the flexible filament, and provides a second electrode electrically connected to the second terminal of the flexible filament. The light bulb apparatus further includes an expanding structure and a driver module. The expanding structure is mechanically coupled to the central support, and includes a plurality of holding portions for holding the flexible filament. The driver module is electrically connected to the bulb head and the central support for providing electrical power to the first electrode and the second electrode of the central support.

In some embodiments, the expanding structure includes two bending strips symmetrically or asymmetrically arranged with respect to a central axis of the central support. And each of the bending strips has a plurality of concave portions as the holding portions to hold the flexible filament. The concave portions may be substantially U-shaped, C-shaped, or G-shaped.

In another embodiment, the expanding structure includes a plurality of support rods arranged along a central axis of the central support. Each of the support rods has a first end mechanically coupled to the central support, and has a second end extending outward from the central support to hold the flexible filament. The second ends of the support rods may be substantially U-shaped, C-shaped, or G-shaped.

In another embodiment, the expanding structure includes a block-shaped pillar having a concave slot. The concave slot is spiral on the surface of the block-shaped pillar for holding the flexible filament. The expanding structure may be made of metal, ceramic, glass, or plastic material. The block-shaped pillar may be hollow or solid inside.

In another embodiment, the expanding structure includes a plurality of support boards. Each of the support boards has a plurality of concave portions as the holding portions to hold the flexible filament. The concave portions may be substantially U-shaped, C-shaped, or G-shaped.

In some embodiments, the central support and the expanding structure may be made of a same material and may be integrally formed.

In some embodiments, the light bulb apparatus includes at least two flexible filaments connected in series or in parallel. The two flexible filaments may emit light of different colors or different color temperatures.

In some embodiments, the holding portions include a blocking structure for preventing the flexible filament from falling out of the holding portions. For example, the holding portions may be G-shaped for preventing the flexible filament from falling out of the holding portions.

BRIEF DESCRIPTION OF DRAWINGS

For a better understanding of the present disclosure, its operating advantages and the specific objects attained by its uses, reference should be made to the accompanying drawings listed below. It is noted that these drawings are for illustration of preferred embodiments only and should not be regarded as limiting.

DETAILED DESCRIPTION

To facilitate a better understanding of the present disclosure, the following examples of certain embodiments are given. In no way should the following examples be read to limit or define the scope of the disclosure.

Figure 1:
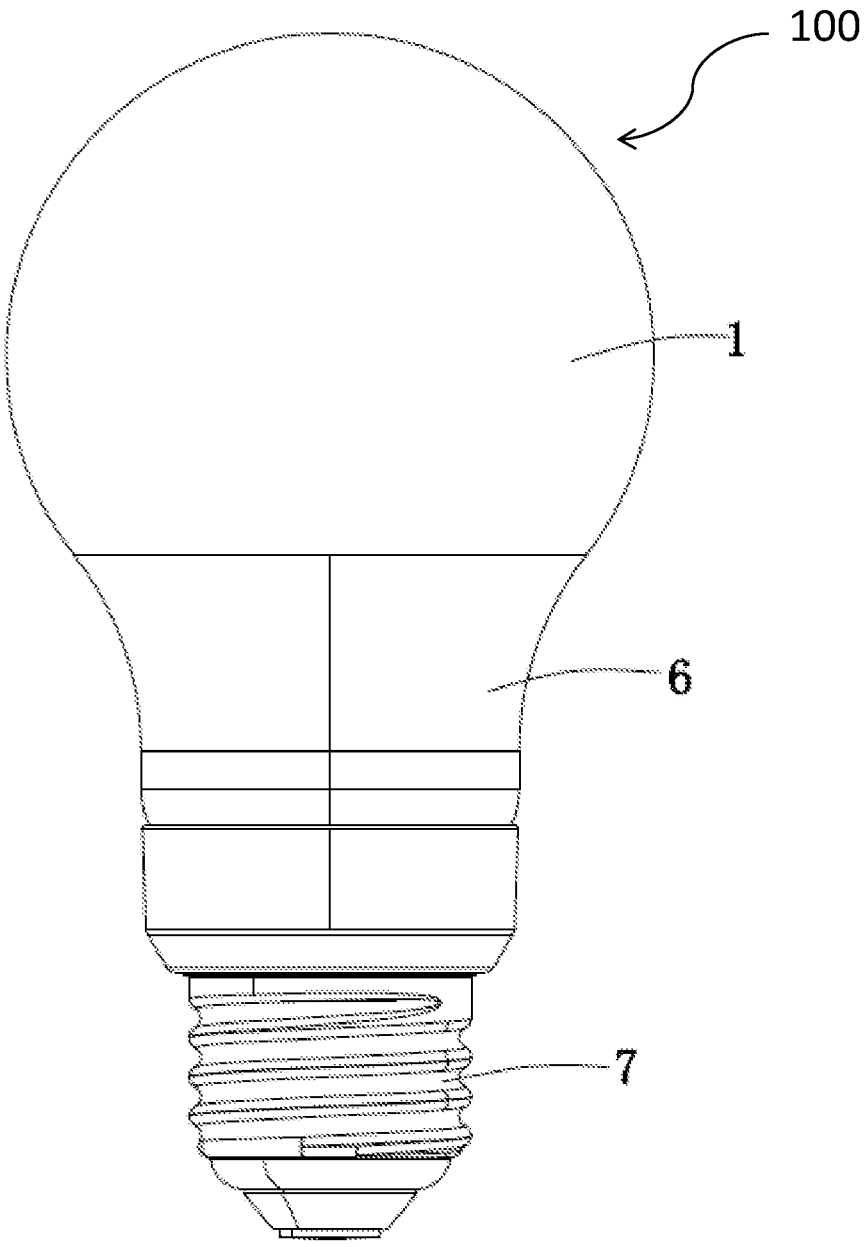
FIG. 1 is a perspective view of a light bulb apparatus according to a first embodiment of the present disclosure.
Figure 2:
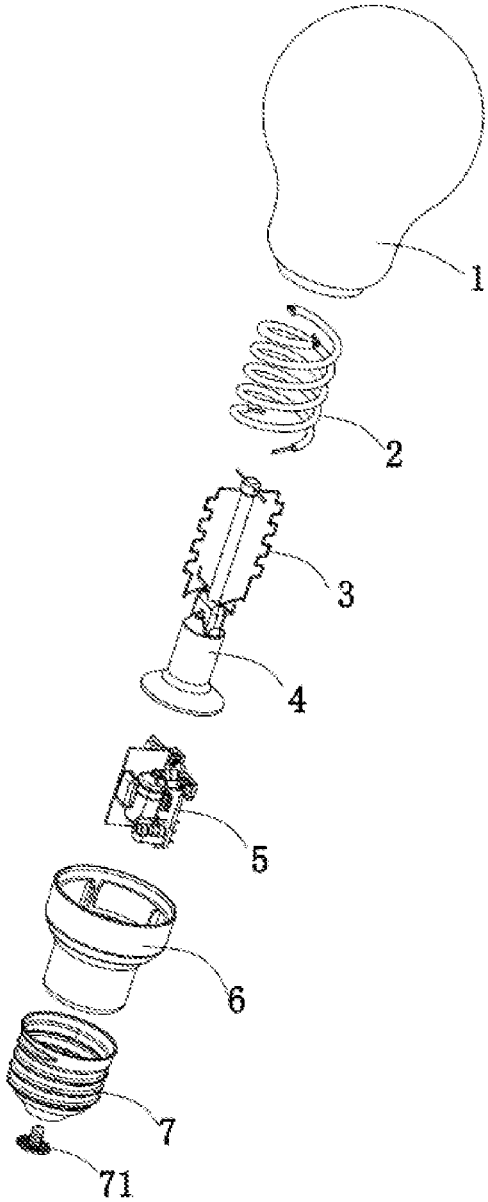
FIG. 2 illustrates the exploded view of the light bulb apparatus according to the first embodiment.

FIGS. 1 to 4 illustrate the first embodiment of the present disclosure. In the first embodiment, the light bulb apparatus 100 includes a light bulb shell 1, a bulb head 7, and a heat sink cup 6. The heat sink cup 6 has a first end and a second end. As shown in FIG. 1 and FIG. 2, the first end of the heat sink cup 6 is connected to the light bulb shell 1, and the second end of the heat sink cup 6 is connected to the bulb head 7. The bulb head 7 may be a traditional Edison bulb head configured to receive external power source for the light bulb apparatus 100.

Refer to FIG. 2. The light bulb apparatus 100 includes a flexible filament 2 and a central support 4. The flexible filament 2 includes one or more LED chips for emitting light. The flexible filament 2 has a first terminal and a second terminal, and the central support 4 provides a first electrode 41 electrically connected to the first terminal of the flexible filament 2, and provides a second electrode 42 electrically connected to the second terminal of the flexible filament 2. The first electrode 41 and the second electrode 42 are physically located away from each other.

The light bulb apparatus 100 further includes an expanding structure 3 and a driver module 5. The expanding structure 3 is mechanically coupled to the central support 4, and includes a plurality of holding portions for holding the flexible filament 2. The driver module 5 includes a driver circuit board and electrical components arranged on the driver circuit board. The driver module 5 is electrically connected to the bulb head 7 and the central support 4, and the driver module 5 is capable of providing electrical power to the first electrode 41 and the second electrode 42 of the central support 4. The first electrode 41 and the second electrode 42 may be made of metal material. The bulb head 7 includes a metal tip 71 located distal to the heat sink cup 6. The bulb head 7 and the metal tip 71 work together to receive external power for the light bulb apparatus 100.

In this embodiment, the central support 4 extends and a part of the central support 4 is located inside the light bulb shell 1, so the flexible filament 2 could be physically located inside the light bulb shell 1.

Figure 3:
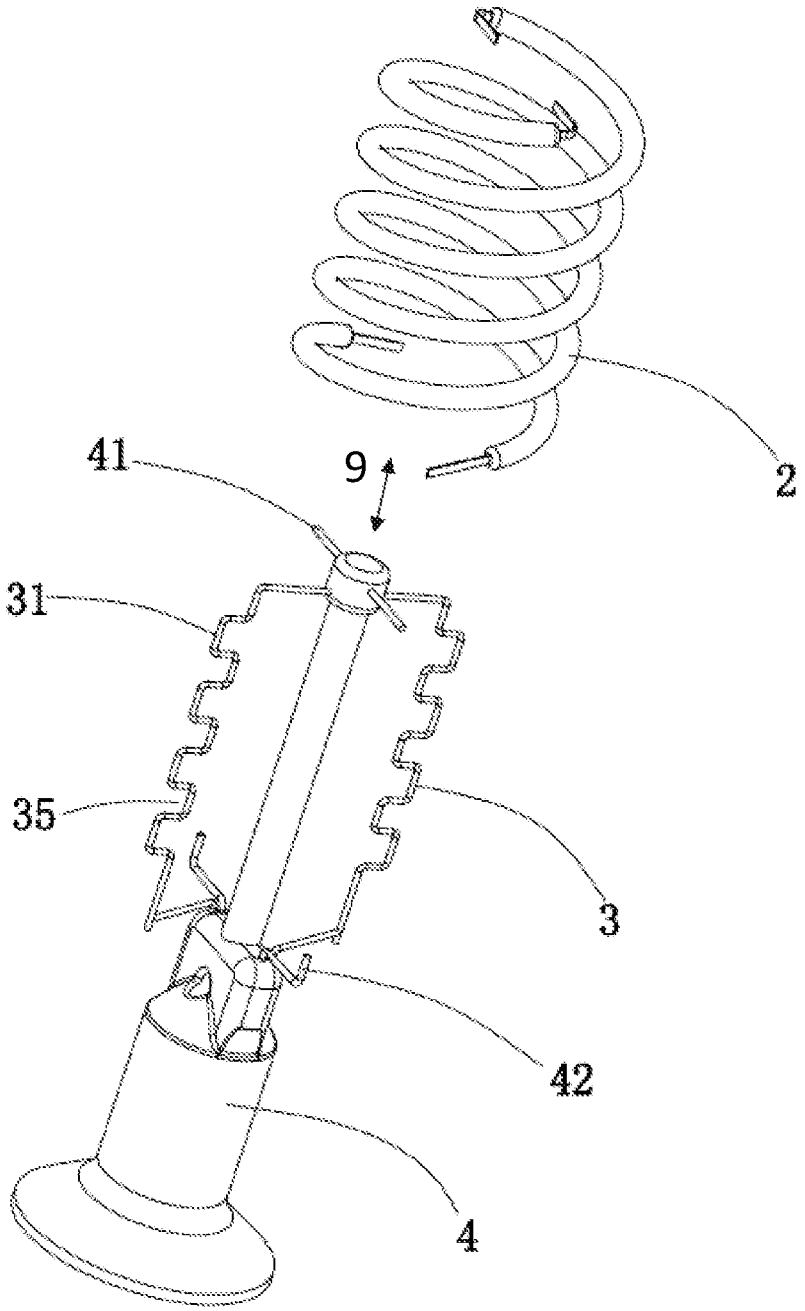
FIG. 3 illustrates the exploded view of the expanding structure and some components of the first embodiment.
Figure 4:
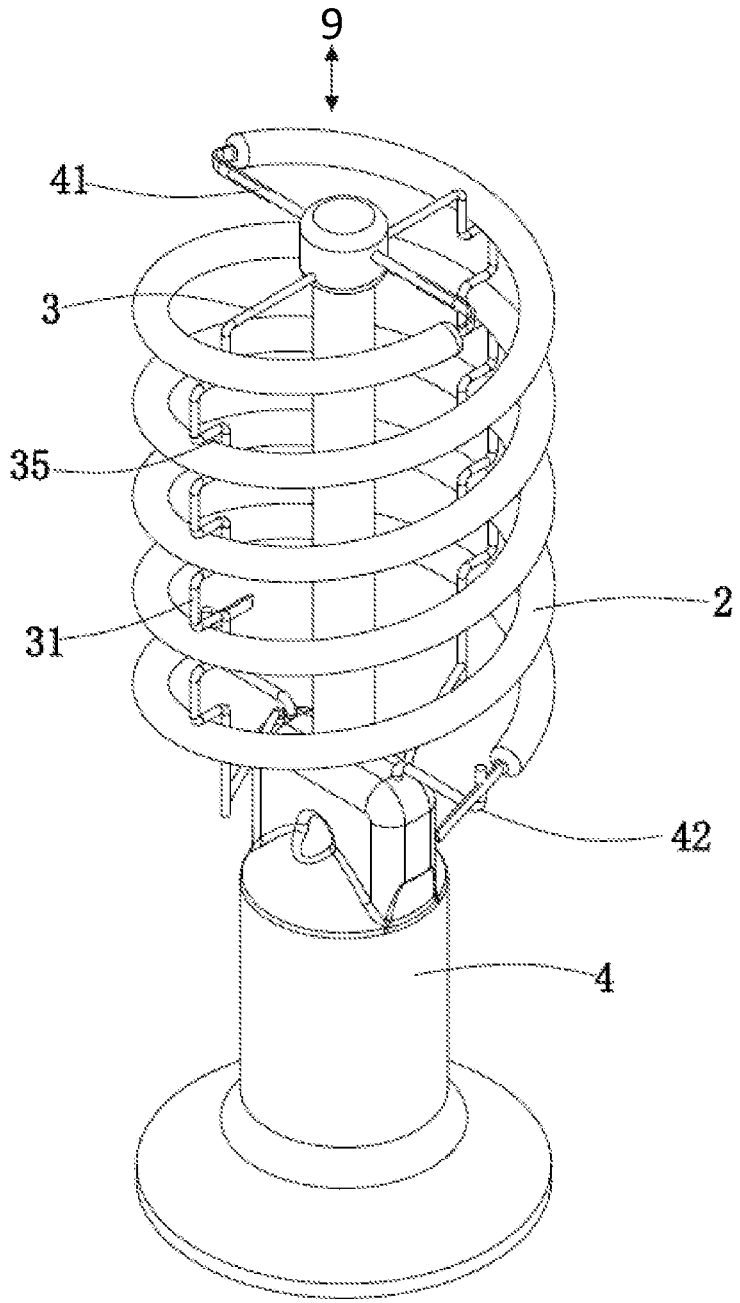
FIG. 4 illustrates an assembly view of the expanding structure and the components in FIG. 3 in the first embodiment.

Refer to FIG. 3 and FIG. 4. In this embodiment, the expanding structure 3 includes two bending strips 31 symmetrically arranged with respect to a central axis 9 of the central support 4. The two bending strips 31 are mechanically coupled to the central support 4. Each of the bending strips 31 has a plurality of concave portions 35 as the holding portions to hold the flexible filament 2. The flexible filament 2 is bent to spiral along a central axis 9 of the central support and is held and fixed by the concave portions 35. The concave portions 35 are substantially U-shaped in this embodiment so as to properly hold and fix the flexible filament 2. Comparing to a traditional way which includes bending the filament to pass through the fixation rings, the new way proposed by the present disclosure is more efficient and reliable, and may reduce the manufacturing cost and improve the production quality.

In this embodiment of the present disclosure, the central support 4 has a horn-type bottom. The horn-type bottom is connected to the light bulb shell 1 by high melting-point soldering, and the flexible filament 2 is sealed inside the light bulb shell 1. There may be heat dissipation gas filled inside the light bulb shell 1 so as to improve the heat dissipation of the light bulb apparatus 100. The heat dissipation gas may be helium, or a combination of helium and oxygen. The central support 4 and the heat sink cup 6 may be connected to each other by glue, by buckles, or by screw thread. The heat sink cup 6 may be made of plastic material. The heat sink cup 6 and the light bulb shell 1 may be connected to each other by glue.

In this embodiment, the first terminal of the flexible filament 2 is soldered to the first electrode 41. Then the flexible filament 2 is bent to spiral and to be held by the concave portions 35 of the expanding structure 3. And then the second terminal of the flexible filament 2 is soldered to the second electrode 42. In another embodiment, the flexible filament 2 may be first bent to spiral and to be held by the concave portions 35 of the expanding structure 3. And then the first terminal and the second terminal of the flexible filament 2 are soldered to the first electrode 41 and the second electrode 42 respectively.

In this embodiment, the bending strips 31 may be made of metal, plastic, or glass material. If the bending strips 31 are made of metal material, the bending strips 31 may be connected to the central support 4 by plug/socket and soldering. If the bending strips 31 are made of plastic or glass material, the bending strips 31 may be connected to the central support 4 by plug/socket and glue. In another embodiment, there may be more than two bending strips 31, for example, there may be four or six bending strips 31 used in the light bulb apparatus 100.

Figure 5:
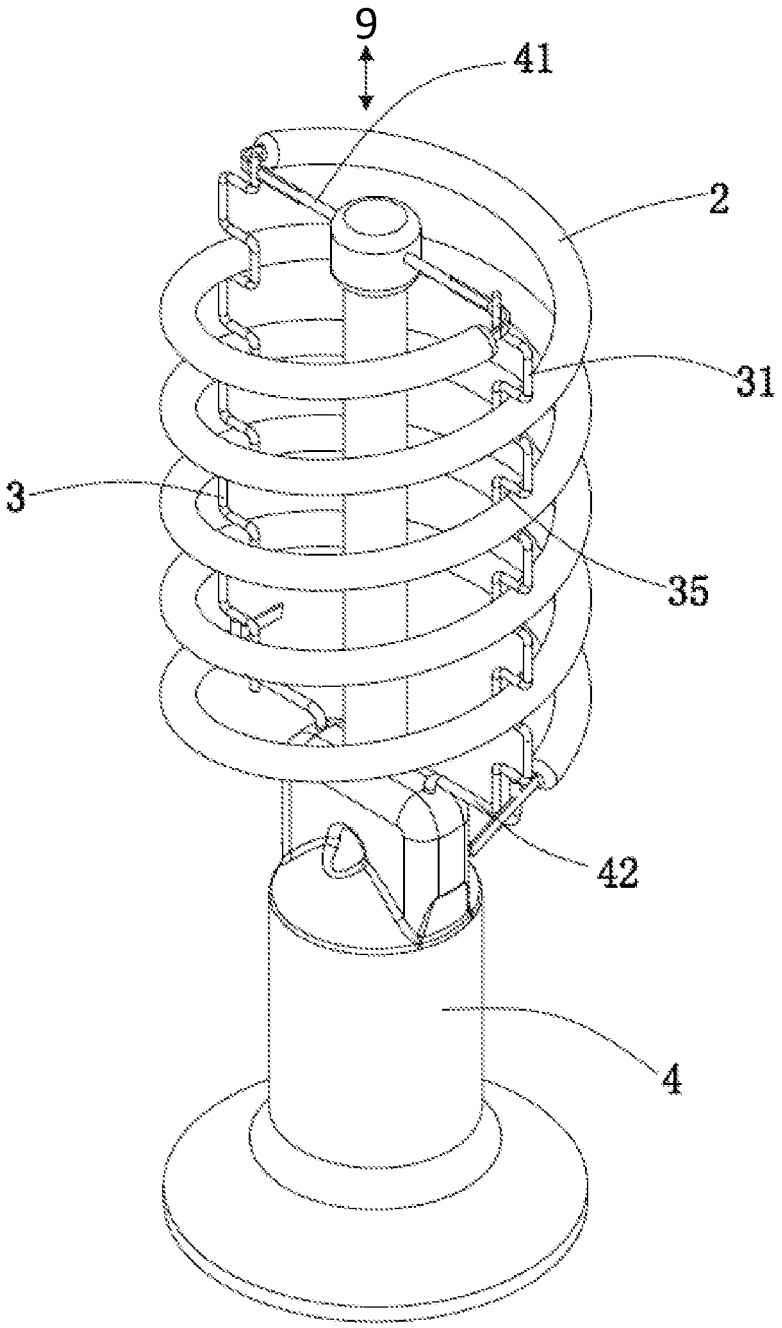
FIG. 5 illustrates an assembly view of the expanding structure and some components according to a second embodiment of the present disclosure.

Refer to FIG. 5, which illustrates a second embodiment of the present disclosure. The second embodiment is similar to the first embodiment, but the two bending strips 31 are mechanically coupled to the first electrode 41 and the second electrode 42. The bending strip 31 may be made of metal, plastic, or glass material. With the arrangement proposed by the second embodiment, the cost for installing the bending strips 31 may be reduced, and it may be more convenient for soldering or gluing the bending strips 31 to the first electrode 41 and the second electrode 42.

Figure 6:
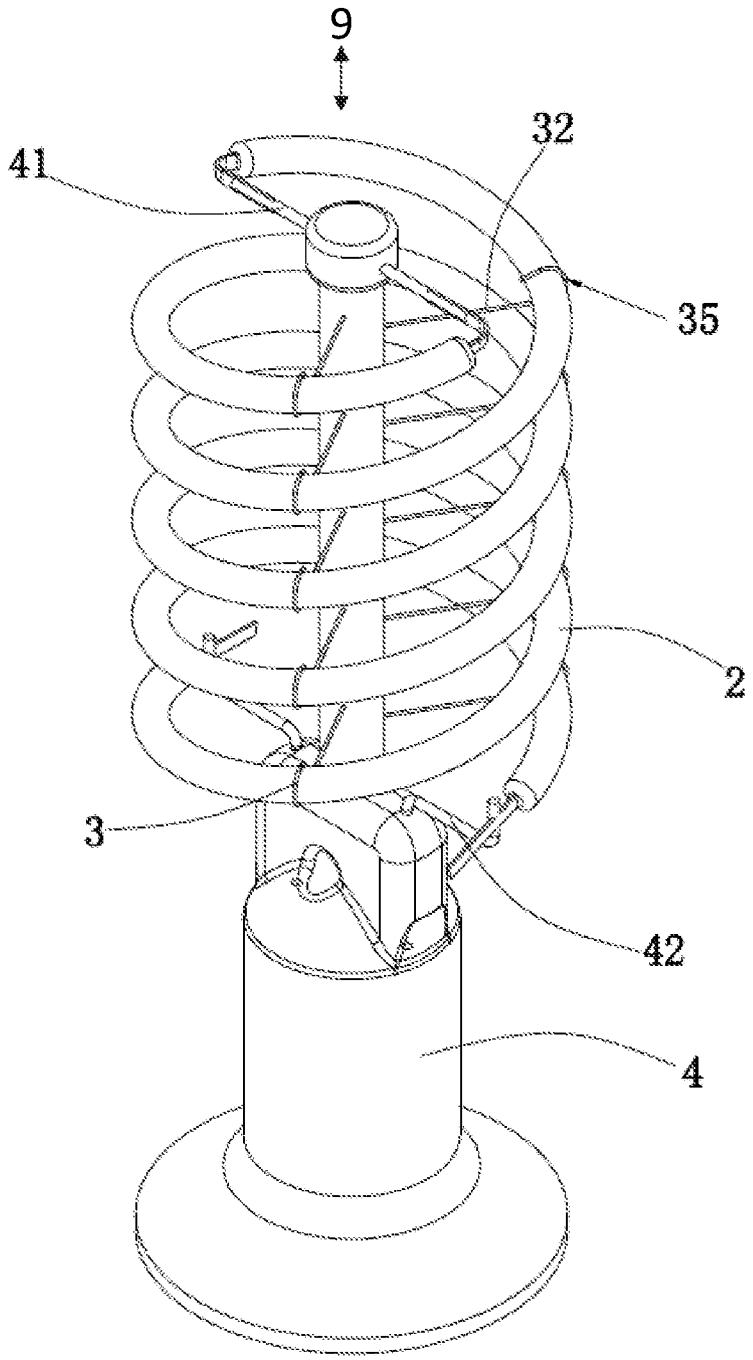
FIG. 6 illustrates an assembly view of the expanding structure and some components according to a third embodiment of the present disclosure.

FIG. 6 illustrates a third embodiment of the present disclosure. In the third embodiment, the expanding structure 3 includes a plurality of support rods 32 arranged along the central axis 9 of the central support 4. The support rods 32 are spaced an equal distance apart from each other on the surface of the central support 4. Each of the support rods 32 has a first end mechanically coupled to the central support 4, and has a second end extending outward from the central support 4 to hold the flexible filament 2. The second ends of the support rods may be bent into substantial U-shape or C-shape, with the open ends of the U-shape or the C-shape facing toward the central axis 9 of the central support 4. It is noted that since the open ends of the U-shape or the C-shape face toward the central axis 9 of the central support 4, the open ends could not be shown in FIG. 6.

In the third embodiment, the support rods 32 may be made of metal, plastic, or glass material. With such arrangement, the material required for composing the expanding structure 3 may be reduced, and the process for installing the expanding structure 3 may also be simplified. In this embodiment, there are at least two groups of support rods 32 arranged parallel to each other so as to properly support the flexible filament 2. The support rods 32 may be connected to the central support 4 by soldering, glue, or screw-thread.

Figure 7:
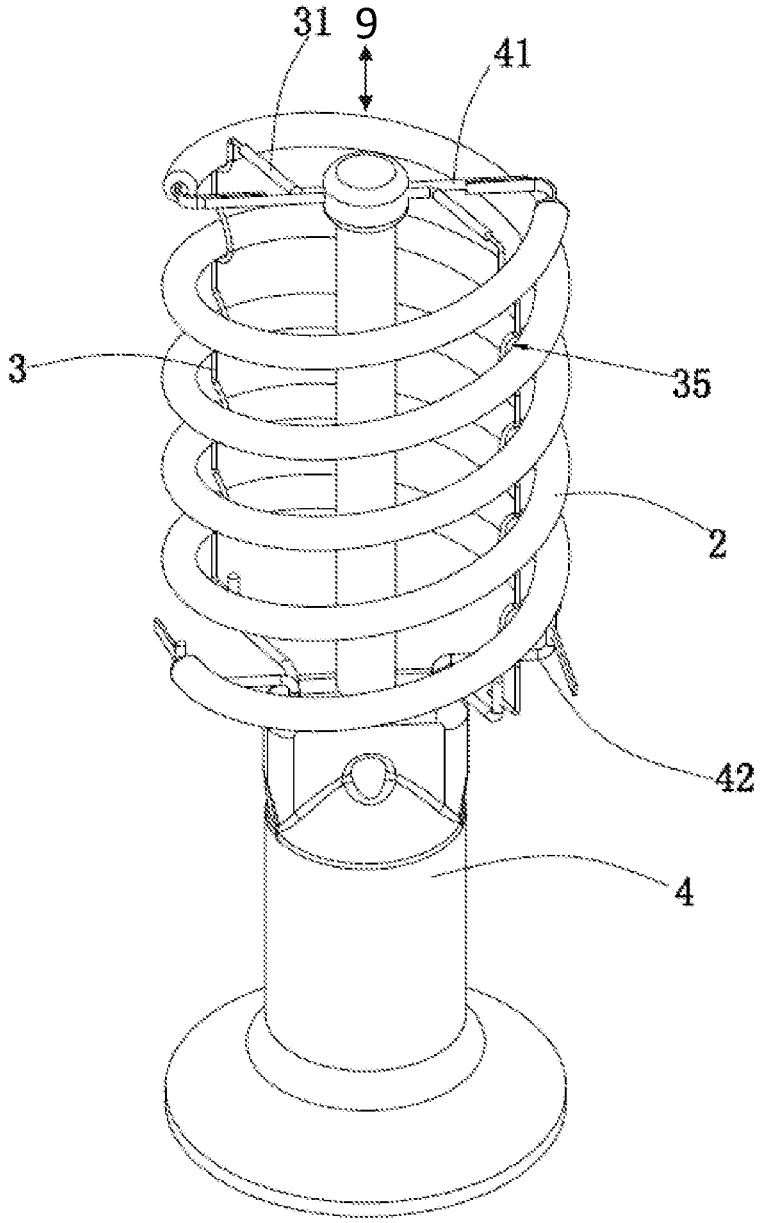
FIG. 7 illustrates an assembly view of the expanding structure and some components according to a fourth embodiment of the present disclosure.

FIG. 7 illustrates the fourth embodiment of the present disclosure. The fourth embodiment is similar to the first embodiment shown in FIG. 4, but the bending strips 31 are asymmetrically arranged with respect to the central axis 9 of the central support 4. The bending strips 31 may be made of metal, plastic, or glass material. In this embodiment, the bending strips 31 are arranged surrounding the central axis 9 of the central support 4 as a circle. In this embodiment, there may be an odd number, for example three or five, of bending strips 31 used in the light bulb apparatus 100.

Figure 8:
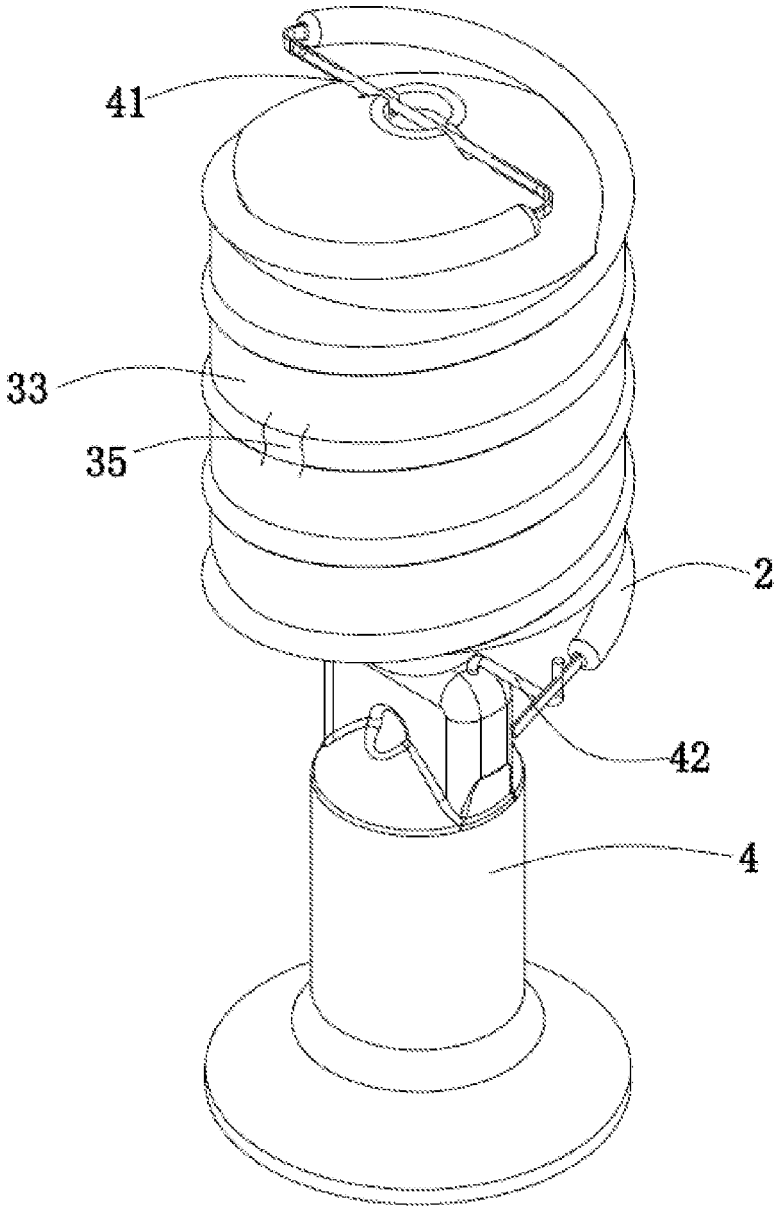
FIG. 8 illustrates an assembly view of the expanding structure and some components according to a fifth embodiment of the present disclosure.

FIG. 8 illustrates the fifth embodiment of the present disclosure. In the fifth embodiment, the expanding structure 3 includes a block-shaped pillar 33 having a concave slot 35. The concave slot 35 is arranged spiral on the surface of the block-shaped pillar 33 for holding the flexible filament 2.

The block-shaped pillar 33 may be hollow inside, so the overall weight of the light bulb apparatus 100 could be reduced. The block-shaped pillar 33 may also be solid inside. The block-shaped pillar 33 may be made of metal, ceramic, glass, or plastic material. Preferably, the block-shaped pillar 33 may be made of transparent glass or plastic material. The block-shaped pillar 33 may be installed onto the central support 4 by glue.

Figure 9:
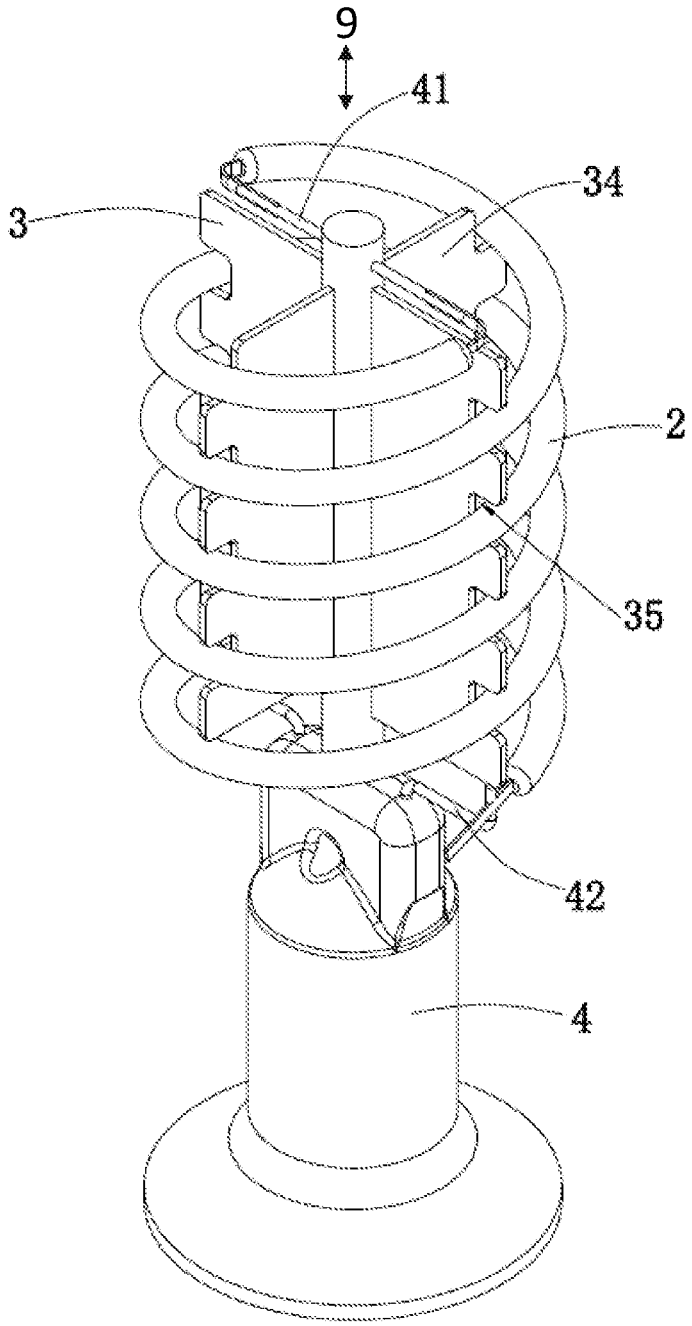
FIG. 9 illustrates an assembly view of the expanding structure and some components according to a sixth embodiment of the present disclosure.

Refer to FIG. 9, which shows the sixth embodiment of the present disclosure. In the sixth embodiment, the expanding structure 3 includes a plurality of support boards 34. Each of the support boards 34 has a plurality of concave portions 35 at its edge area as the holding portions to hold the flexible filament 2. The concave portions 35 may be substantially U-shaped or C-shaped. In this embodiment, there are four support boards 34 arranged in the shape of a cross. The support boards 34 may be made of metal, ceramic, glass, or plastic material. Preferably, the support boards 34 are made of transparent glass or plastic material. The support boards 34 are connected to the central support 4 by soldering or glue. In another embodiment, there may be three, five, or six support boards 34 used in the light bulb apparatus 100.

In some embodiments, the central support 4 and the expanding structure 3 may be made of a same material and may be integrally formed. In this way, the manufacturing cost for the light bulb apparatus 100 may be further reduced.

In the above embodiments, the holding portions are substantially U-shaped or C-shaped. The size of the open ends of the U-shapes or the C-shapes should be suitable to properly hold and fix the filament 2. In some other embodiments, the holding portions may further include a blocking structure so as to prevent the flexible filament 2 from falling out of the holding portions. For example, the holding portions may be G-shaped, so the holding portions would include a blocking structure to properly prevent the flexible filament 2 from falling out of the holding portions.

In some embodiments, the light bulb apparatus 100 may include two or more flexible filaments 2 connected in parallel. Accordingly, there are two or more sets of the first electrodes 41 and the second electrodes 42, with each set of the first electrode 41 and the second electrode 42 electrically connected to one of the flexible filaments 2. Each of the flexible filaments 2 includes one or more LED chips capable of emitting light. With such arrangement, if one flexible filament 2 fails, the other ones may continue to provide lighting.

Alternatively, each of the flexible filaments 2 may include one or more LED chips capable of emitting light of different colors (e.g., red, green, or blue . . . ) or different color temperatures (e.g., 3000K, 4500K, or 6000K . . . ). With such arrangement, the light bulb apparatus 100 may emit light of different color or different color temperature by providing power to one or a combination of the flexible filaments 2.

In another embodiment, the two or more flexible filaments 2 may be connected in series.

In the above embodiments, the light bulb apparatus of the present disclosure includes an expanding structure having holding portions to properly hold the flexible filament. The expanding structure may be bending strips, support rods, block-shaped pillar, or support boards . . . etc. As illustrated above, the expanding structure according the present disclosure is easy to implement and install, and may be applied in various lighting apparatuses. High production quality and manufacturing efficiency of the light bulb apparatus may be achieved.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claim:

1. A light bulb apparatus, comprising:

a light bulb shell;

a bulb head;

a heat sink cup having a first end and a second end, the first end of the heat sink cup is connected to the light bulb shell, and the second end of the heat sink cup is connected to the bulb head;

a flexible filament for emitting light, the flexible filament has a first terminal and a second terminal;

a central support for providing a first electrode and a second electrode, the first electrode of the central support is electrically connected to the first terminal of the flexible filament, and the second electrode is electrically connected to the second terminal of the flexible filament;

an expanding structure mechanically coupled to the central support, the expanding structure includes a plurality of holding portions for holding the flexible filament, and a driver module for electrically connected to the bulb head and the central support for providing electrical power to the first electrode and the second electrode of the central support, wherein the expanding structure comprises a plurality of support boards, each of the support boards has a plurality of concave portions as the holding portions to hold the flexible filament.

2. The light bulb apparatus of claim 1, wherein the expanding structure comprises two bending strips symmetrically arranged with respect to a central axis of the central support, and each of the bending strips has a plurality of concave portions as the holding portions to hold the flexible filament.

3. The light bulb apparatus of claim 2, wherein the concave portions are substantially U-shaped, C-shaped, or G-shaped.

4. The light bulb apparatus of claim 1, wherein the expanding structure comprises two bending strips asymmetrically arranged with respect to a central axis of the central support, and each of the bending strips has a plurality of concave portions as the holding portions to hold the flexible filament.

5. The light bulb apparatus of claim 4, wherein the concave portions are substantially U-shaped, C-shaped, or G-shaped.

6. The light bulb apparatus of claim 1, wherein the expanding structure comprises a plurality of support rods arranged along a central axis of the central support, each of the support rods has a first end mechanically coupled to the central support and a second end extending outward from the central support to hold the flexible filament.

7. The light bulb apparatus of claim 6, wherein the second ends of the support rods are substantially U-shaped, C-shaped, or G-shaped.

8. The light bulb apparatus of claim 1, wherein the expanding structure comprises a block-shaped pillar having a concave slot, the concave slot is spiral on a surface of the block-shaped pillar for holding the flexible filament.

9. The light bulb apparatus of claim 8, wherein the expanding structure is made of metal, ceramic, glass, or plastic material.

10. The light bulb apparatus of claim 8, wherein the block-shaped pillar is hollow inside.

11. The light bulb apparatus of claim 8, wherein the block-shaped pillar is solid inside.

12. The light bulb apparatus of claim 1, wherein the expanding structure is made of metal, ceramic, glass, or plastic material.

13. The light bulb apparatus of claim 1, wherein the concave portions are substantially U-shaped, C-shaped, or G-shaped.

14. The light bulb apparatus of claim 1, wherein the central support and the expanding structure are made of a same material and are integrally formed.

15. The light bulb apparatus of claim 1, wherein the light bulb apparatus comprises at least two flexible filaments connected in series or in parallel.

16. The light bulb apparatus of claim 15, wherein the at least two flexible filaments are capable of emitting light with different colors or different color temperatures.

17. The light bulb apparatus of claim 1, wherein the holding portions includes a blocking structure for preventing the flexible filament from falling out of the holding portions.

18. The light bulb apparatus of claim 17, wherein the holding portions are G-shaped for preventing the flexible filament from falling out of the holding portions.

19. The light bulb apparatus of claim 1, wherein the expanding structure is mechanically coupled to the first electrode and the second electrode.

* * * * *